US005388950A

United States Patent [19]

Schmahl et al.

[11] Patent Number: 5,388,950

[45] Date of Patent: Feb. 14, 1995

[54] BUMPER QUICK-ATTACH FOR TRACTOR FRONT-END LOADERS

[75] Inventors: Calvin O. Schmahl, Chilton, Wis.; David L. Apple, Muskegon, Mich.; Edward T. Kaczmarczyk, Daniel R. Fuzzen, both of Wellard, Canada

[73] Assignees: Deere & Company, Moline; Amerequip Corporation, Chicago, both of Ill.

[21] Appl. No.: 110,444

[22] Filed: Aug. 23, 1993

[51] Int. Cl.[6] ..... E02F 3/72

[52] U.S. Cl. ..... 414/686; 414/723

[58] Field of Search ..... 414/723, 686, 680; 172/272–275; 37/468

[56] References Cited

U.S. PATENT DOCUMENTS 3,944,089 3/1976 Polyanin et al. .
4,345,870 8/1982 Anderson et al. .
4,470,751 9/1984 Masuzawa et al. .
4,565,484 1/1986 Hamada et al. ..... 414/686
4,793,764 12/1988 Hamm ..... 414/686
4,798,511 1/1989 Kaczmarczyk et al. .
4,802,814 2/1989 Kourogi et al. .
4,936,737 6/1990 Rae et al. .

*Primary Examiner*—Donald W. Underwood

[57] ABSTRACT

A loader includes a pair of rear supports projecting transversely outwardly from a longitudinally extending tractor frame. The loader further includes a pair of posts having receptacles at the bottoms thereof which are received about the rear supports when the posts are in upright dispositions, the receptacles being shaped for then retaining the posts on the supports. A weight bracket forms a bumper at the forward end of the tractor and a yoke extends forwardly from the posts and has a bight portion including a remotely operable releasable latch mechanism which releasably latches the bight portion to the weight bracket.

13 Claims, 3 Drawing Sheets

BUMPER QUICK-ATTACH FOR TRACTOR FRONT-END LOADERS

The present invention relates to a tractor-mounted loader and more particularly relates to structure for attaching or detaching the loader front yoke or U-shaped brace of a front-mounted loader to or from the tractor.

Designers have spent a lot of effort trying to come up with designs which permit a loader to be easily attached to, or detached from, a tractor. As considered when mounted on a tractor, these loaders typically include a pair of spaced apart, upright masts or standards respectively having lower ends coupled to frame members extending outwardly from the tractor frame. The rear ends of a pair of loader arms are pivotally attached to upper ends of the masts and a pair of boom cylinders are coupled between the masts and the arms for raising and lowering the arms relative to the tractor. A yoke or U-shaped brace structure has a pair of legs respectively rigidly attached to the masts at locations below the upper ends thereof and joined together by a transverse bight portion extending ahead of and releasably coupled to a forward end of the tractor. It is the connections between the bottom ends of the masts and the tractor-mounted frame members and between the bight portion of the yoke or brace and the front end of the tractor that designers have been trying to simplify. The present invention relates to the connection of the yoke bight portion to the forward end of the tractor.

Typically, a tractor is provided with brackets or hangers adapted for having the yoke releasably attached thereto. These brackets or hangers are usually intended to stay with the tractor even when the loader is detached and, in the case of relatively small tractors, such as those used for lawn and garden work, sometimes present a hinderance to the attachment of other front accessories such as blades, snowblowers, brooms and front mowers. In any event, these mounting brackets or hangers are an additional component required for the complete loader package and thus add to the cost of such a package. Furthermore, attaching hardware is often required for securing the yoke to the mounting brackets or hangers and makes it necessary for an operator to take care not to lose or misplace the hardware. U.S. Pat. No. 4,470,751 granted to Masuzawa et al on Sep. 11, 1984 and U.S. Pat. No. 4,802,814 granted to Kourogi et al on Feb. 7, 1989 exemplify this type of prior art.

Other designs are known which employ brackets or hangers which define receptacles for the reception of bight portions of the loader yoke or U-shaped brace with either the shape of the receptacle or a remotely operable latch being used to retain the bight portion in the receptacle. U.S. Pat. No. 4,798,511 granted to Kaczmarczyk et al on Jan. 17, 1989 and U.S. Pat. No. 4,936,737 granted to Rae et al on Jun. 26, 1990 are representative of this type of structure.

The prior art even discloses the idea of using structure such as the tractor bumper, instead of additional brackets or hangers, as the element which supports the bight portion of the yoke or U-shaped brace. U.S. Pat. No. 3,944,089 granted to Polyanin et al on Mar. 16, 1976 and U.S. Pat. No. 4,345,870 granted to Anderson et al on Aug. 24, 1982 discloses such a structure, with the '089 design requiring attaching hardware and the '870 design not requiring attaching hardware. The present invention is of this latter type which uses structure normally found on the tractor front end for the attachment of the yoke bight and which does not require any attachment hardware.

SUMMARY OF THE INVENTION

The present invention relates to structure for mounting a loader to a tractor, and more specifically relates to an improved structure for mounting the bight portion of the yoke or U-shaped brace to structure normally found at the front end of the tractor.

An object of the invention is to provide an improved structure for mounting the bight portion of the yoke of a front-end loader to a tractor without requiring the use of mounting brackets or hangers or the use of attaching hardware.

A more specific object of the invention is to provide a mounting structure, as set forth in the previous object, wherein the bight portion of the yoke or U-shaped brace of the loader is defined in part by a cross member fixed between a pair of side plates and a rotatable latch member which, when in an rearwardly rotated latched position, cooperates with the cross member to define a rearwardly opening channel receiving a structure normally found at the forward end of the tractor.

Yet a more specific object of the invention is to provide the mounting structure defined in the immediately preceding object wherein the bight portion includes guide tabs for guiding the loader into supported engagement with a weight bracket located at the forward end of the tractor main frame during mounting the loader to the tractor.

These and other objects of the invention will become apparent from a reading of the ensuing description together with the appended drawings.

DESCRIPTION OF THE PREFERRED EMBODIMENT

Figure 1:
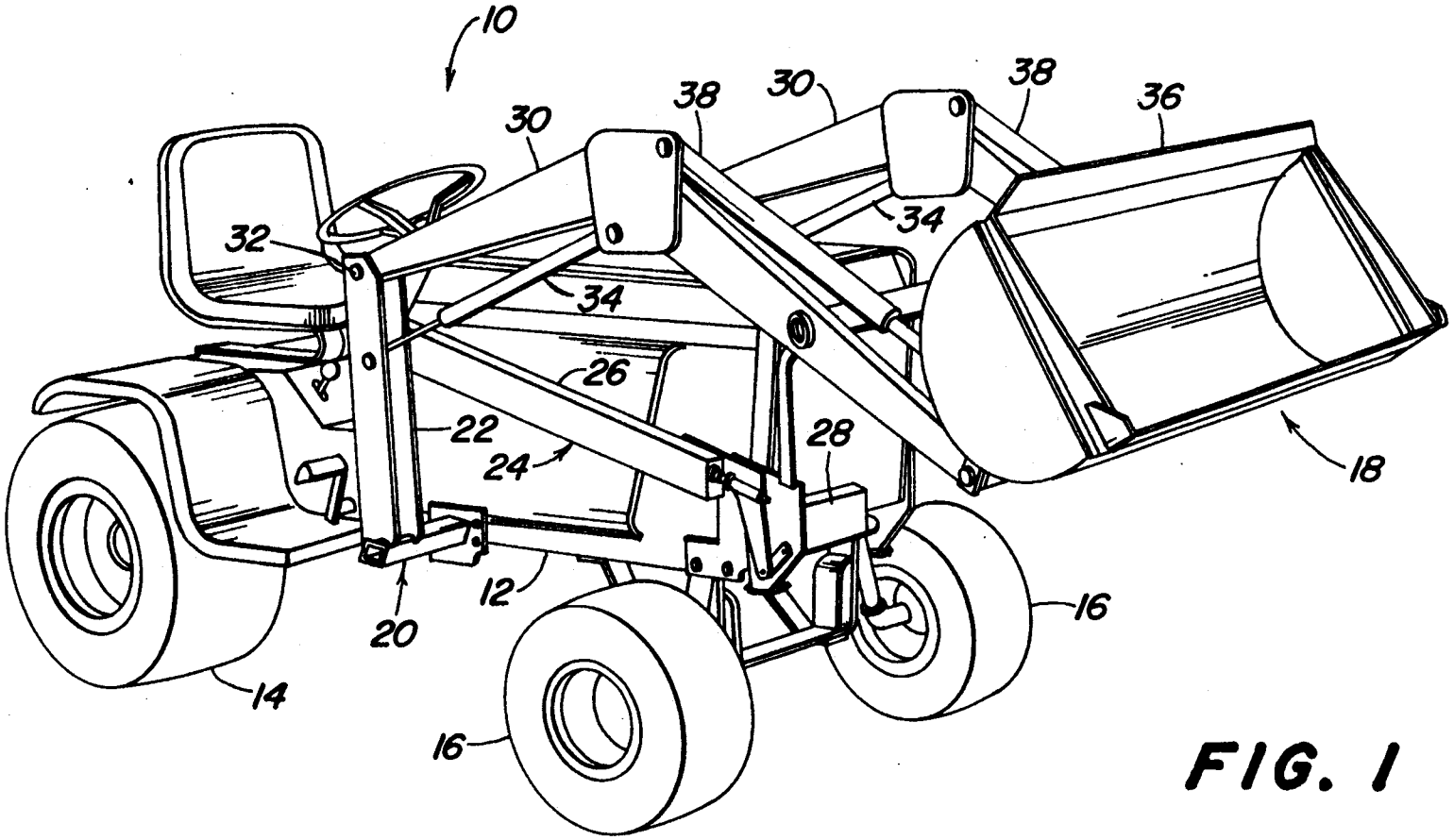
FIG. 1 is a right front perspective view of a tractor with the loader of the present invention attached thereto.

Referring to FIG. 1, there is shown a tractor 10 having a main frame 12 supported for movement over the ground by a pair of rear drive wheels 14 and a pair of front wheels 16. A loader 18 is coupled to horizontal, transverse rear supports 20 coupled or joined to and projecting from opposite sides of the frame 12, and is coupled to a weight bracket 21 (FIGS. 2, 3 and 5) located at the forward end of the frame 12.

Specifically, the loader 18 is symmetrical about a fore-and-aft centerline and includes a pair of upright masts or posts 22 (only the right mast being visible) respectively located at opposite sides of the tractor with the lower ends of the posts 22 being releasably secured to the rear supports 20 in a manner described below in detail. A U-shaped yoke or brace 24 has legs 26 disposed along opposite sides of the tractor 10 with rear ends of the legs 26 being respectively fixed to the masts 22 at inside locations spaced downwardly from the tops of the masts, and with forward ends of the legs 26 being joined together by a bight portion 27 including an integrated parking stand and releasable latch structure 28 which is releasably secured to the weight bracket 21 fixed to or forming an integral part of the tractor frame 12. A loader boom includes a pair of loader arms 30 that are respectively in fore-and-aft alignment with the masts 22 and have rear ends pivotally mounted, as at 32, to upper ends of the masts for vertical movement. A pair of boom cylinders 34 are each coupled between one of the masts 22 and an adjacent one of the arms 30 and are selectively extensible and retractable in concert for raising and lowering the arms about their respective pivot connections 32. Pivotally mounted to the forward ends of the arms 30 is a bucket 36 and a pair of bucket cylinders 38 are each coupled between one of the arms 30 and the bucket 36.

Figure 3:
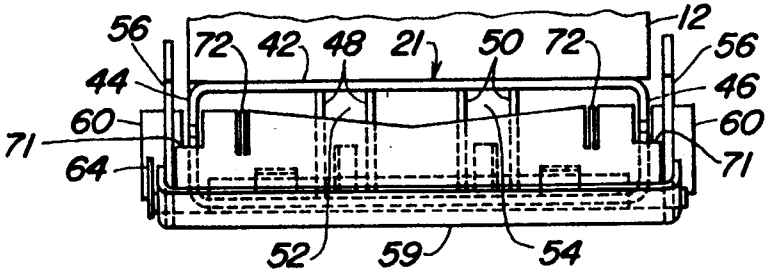
FIG. 3 is a top view of the bight portion of FIG. 2.
Figure 5:
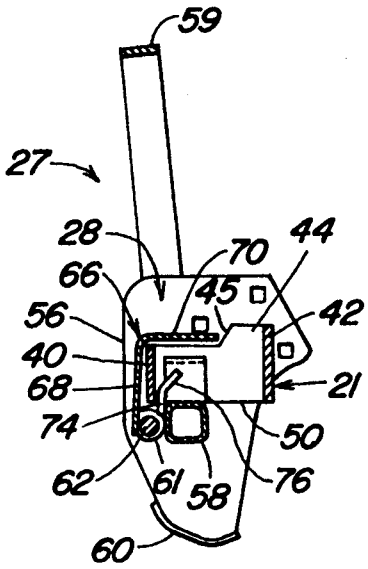
FIG. 5 is a vertical sectional view taken along line 5—5 of FIG. 2.
Figure 2:
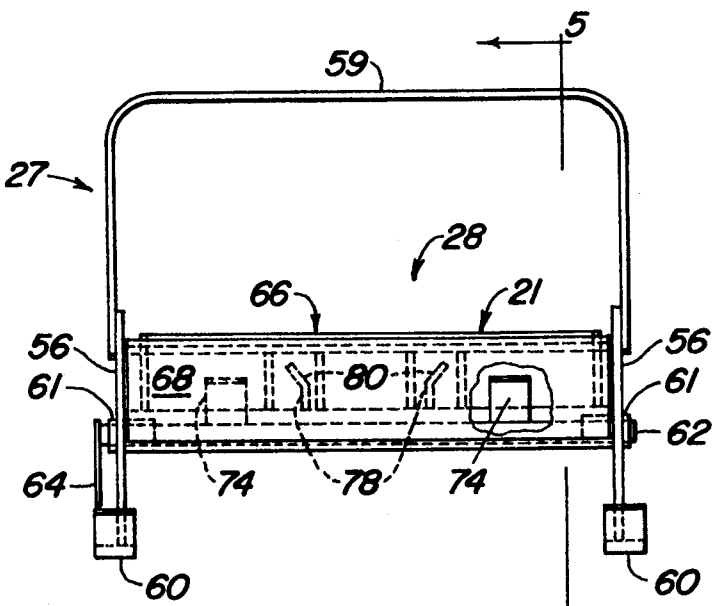
FIG. 2 is a front elevational view showing the bight portion of the loader yoke with the latch in a closed position wherein it is engaged with the tractor weight bracket.

The present invention resides in the structure of the bight portion 27 of the yoke 24 which permits the latter to be releasably latched to the weight bracket 21 of the tractor 10. It will become apparent from the description below that the invention can have utility with various structures normally found at the front of a tractor, such as weight brackets and/or bumpers and the like. With reference to FIGS. 2, 3 and 5, it can be seen that the weight bracket 21 disclosed herein includes spaced, parallel, vertical front and rear walls 40 and 42 (FIG. 5), respectively, defined by plate material and having their opposite ends joined together by right and left end walls 44 and 46 (FIG. 3), respectively, the upper edges of the latter each having a downwardly stepped forward portion 45. Spaced inwardly from and extending parallel to the end walls 44 and 46 are right and left pairs of stiffener ribs 48 and 50 which are respectively equispaced from a point midway between the end walls 44 and 46. The ribs of each pair are spaced a short distance from each other to respectively define relatively narrow openings 52 and 54 at respective locations at opposite sides of and equidistant from the middle point between the opposite end walls 44 and 46.

Figure 7:
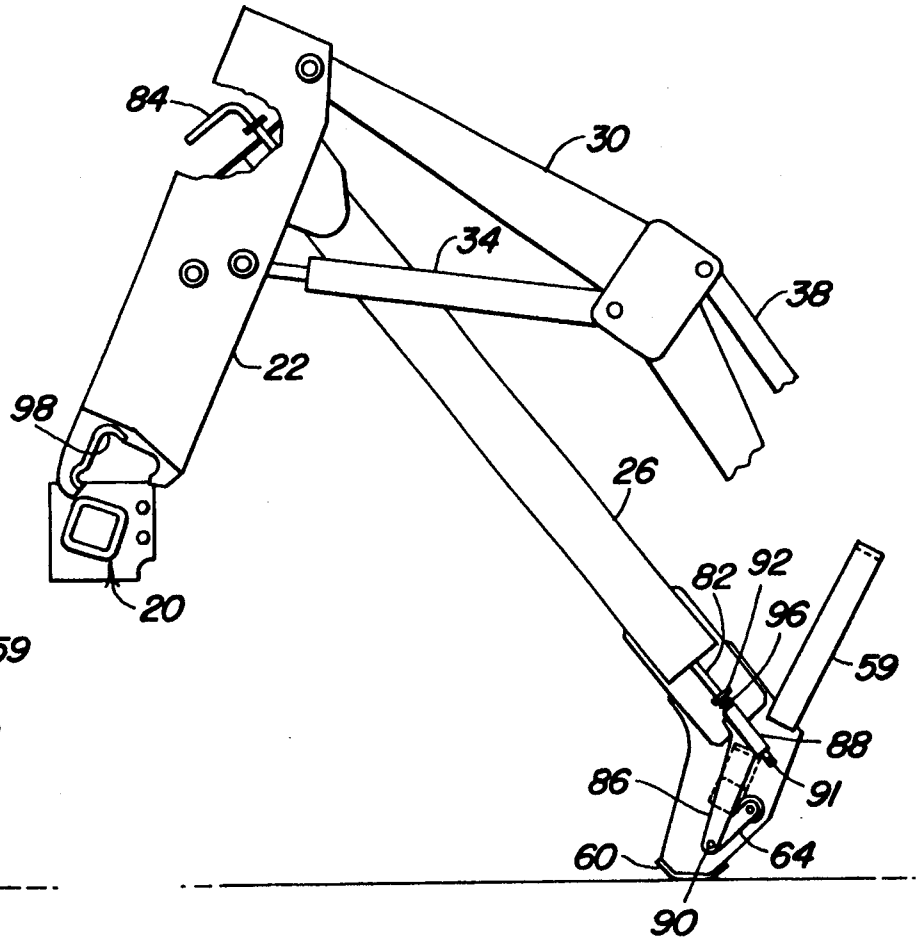
FIGS. 6 and 7 are right side elevational views of the loader, with portions omitted for simplicity, respectively showing the loader in intermediate and final stages during the dismounting of the loader from the tractor.
Figure 6:
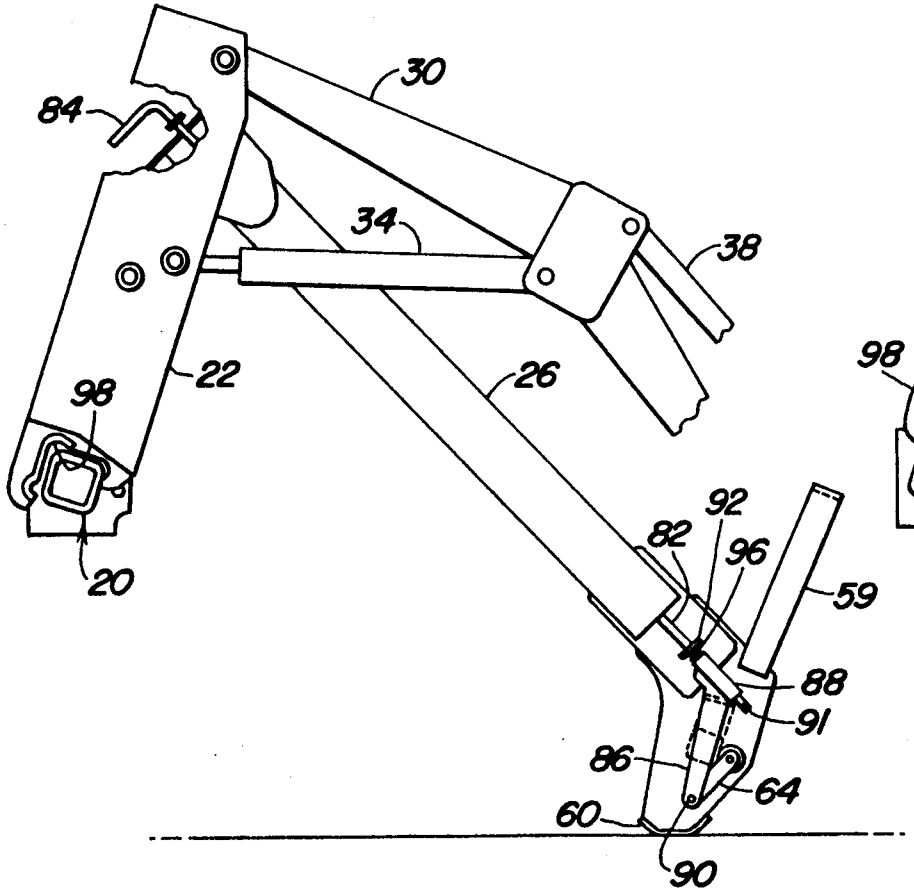

The yoke bight portion 27 comprises a pair of laterally spaced, parallel side plates 56 bolted to the forward ends of the yoke legs 26 and joined to each other by a cross member 58 here shown as a tube which is square in cross section. An upright, inverted U-shaped guard 59 has lower portions of its legs respectively welded to upper forward locations of the side plates 56. Welded to the lower edge portion of each side plate 56 is a support shoe 60 provided for engaging the ground when the loader masts are tilted forwardly for detaching the loader from or for attaching the loader to the tractor, as shown in FIGS. 6 and 7. Welded in place in axially aligned holes provided in the side plates 56 at respective locations just forwardly of the cross member 58 are respective short cylindrical tubes 61 that define a pivot mounting for a latch rod 62 that is pivotally received in the tubes 61. A crank arm 64 is welded to the right end of the rod 62. A latch plate 66, which is inverted L-shaped in cross section, extends transversely between the tubes 61 and has the lower end of a first leg 68 thereof welded to a forward central portion of the rod 58. A second leg 70 of the plate 66 is joined to the top of and extends rearwardly from the first leg. The latch plate 66 is dimensioned so that, when the cross member 58 is engaged with the bottom of the weight bracket 21 and the latch plate is in its latched or closed position shown in solid lines in FIG. 5, the corner formed at the junction of the legs 68 and 70 is in engagement with the corner of the weight bracket 21 formed by the intersection of top surface of the bracket, formed by the upper surface of the weight bracket front wall 40 and the upper surface of each of the pairs of stiffener ribs 48 and 50, with a front surface of the weight bracket front wall 40. It is here noted that the second leg 70 has a pair of notches 71, to receive wall portions 45, and a pair of knock out strips 72 extending fore-and-aft at respective locations spaced inwardly a short distance from opposite ends of the leg 70. Each knock out strip 72 is bordered by a pair of closely spaced slots extending rearwardly from a forward edge of the leg 70 to a location adjacent the area where the legs 68 and 70 are joined together. The purpose of the strips 72 is to permit the latch plate 66 to be used with a weight bracket having a different configuration requiring the knock out strips to be removed leaving slots for providing clearance permitting fore-and-aft walls or ribs of such differently configured weight bracket to project through the slots when the latch plate is in its closed position.

Provided for guiding the yoke bight portion 27 into proper engagement with the weight bracket 21 are a first pair of upright guide straps or tabs 74 respectively located so as to be approximately half way between the right weight bracket wall 44 and the right pair of stiffener ribs 48, and between the left weight bracket wall 46 and the left pair of stiffener ribs 50. The tabs 74 each have an upright lower end welded to a forward face of the cross member 58 at locations disposing the tabs adjacent a rear face of the front weight wall 40. Upper end portions 76 (FIG. 5) of the tabs 74 are inclined forwardly and serve to guide the weight bracket front wall 40 into location above the pin 62. A second pair of guide straps or tabs 78, similar in construction to but rotated 90 degrees relative to the tabs 74, are welded to a top surface of the cross member 58 at respective locations for entering the openings 52 and 54 respectively defined by the pairs of stiffener ribs 48 and 50. Each of the tabs 78 have upper end portions 80 (FIG. 2) inclined outwardly so as to respectively engage the outer ones of the pairs of ribs 48 and 50 during mounting of the loader to the tractor so as to center the yoke bight portion 27 relative to the weight bracket 21.

Figure 4:
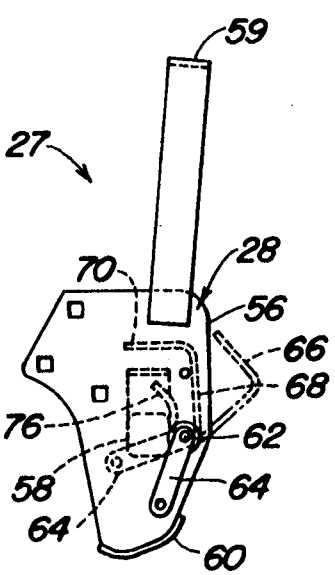
FIG. 4 is a right side elevational view of the bight portion of the yoke shown in FIG. 2 but omitting the weight bracket for clarity and showing the latch in broken lines in an open position wherein it would be free of the weight bracket.

Referring now to FIGS. 6 and 7, it can be seen that a latch control rod 82 extends through the right leg 26 of the yoke or brace 24 and is mounted thereto for limited fore-and-aft movement. The rear end of the control rod 82 is bent at a right angle to the remainder of the rod to thus form a handle 84. A link 86 has a tubular upper end 88 slidably received on the forward end of the rod 82 and a lower end pivotally attached to a lower end of the crank arm 64, as at pin 90. Relative movement between the rod 82 and the tubular end 88 of link 86 is limited by a pin 91 located in a forward end of the rod and a stop washer 92 fixed to the rod a short distance from the link. A spring 96 acts between the stop washer 92 and a rearward end of the link tubular end 88 and biases the link 86 forwardly to thus bias the latch plate 66 toward its latched position shown in hidden lines in FIG. 4. Still referring to FIGS. 6 and 7, it can be seen that at the bottom of each of the masts 22 there is formed a downwardly opening receptacle 98 shaped for retaining the masts on the supports 20 when the masts are substantially vertical, as shown in FIG. 1.

The operation of the releasable latch mechanism 28 is now described in the context of detaching the loader 18 from the tractor 10. Beginning with the loader 18 mounted on the tractor 10, as shown in FIG. 1, the masts 22 will each be in an upright disposition with the supports 20 located in the receptacles 98 and prevented from escape therefrom due to each receptacle including front and rear contact surfaces engaging a respective support 20 at locations which are below and closer together than the diagonal distance between the upper front and lower rear corners the support 20. At this time the bight portion cross member 58 will be in engagement with the bottom of the weight bracket 21 and the latch plate 27 will be in its closed or latched position wherein the corner defined by the intersection of the first and second legs 68 and 70 is engaged with the corner defined by the front and top surfaces of the weight bracket front wall 40.

The first step required in detaching the loader 18 from the tractor 10 is to operate the cylinder 34 to lower the bucket 36 to the ground. Next, the operator will grasp the latch rod handle 84 and pull back to effect forward pivotal movement of the latch plate 66 to its open or unlatched position, shown in broken lines in FIG. 4. The cylinders 34 are then extended to effect forward rotation of the posts 22 about the supports 20 resulting in the simultaneous lowering of the bight portion 27. When the shoes 60 come into engagement with the ground, as shown in FIG. 6, further extension of the cylinders 34 results in the posts 22 being lifted off the supports 20. The tractor 10 is then backed to a location placing the front wheels 16 just behind the posts 22 whereupon the cylinders 34 may be retracted to place the rods thereof in the protected confines if the cylinders, the posts 22 pivoting downwardly during such retraction. The steps described above may be reversed for reattaching the loader 18 to the tractor 10, it being noted that once the latch plate 66 is once again placed in its closed or latched position, the spring 96 will act to resiliently retain the latch plate in this position. It will be appreciated that detachment and attachment of the loader 10 from and to the tractor 10 may be done without requiring any tools or adjustment of any kind.

We claim:

1. In a loader including a pair of transversely spaced upright posts respectively releasably secured to a pair of rear supports carried by and projecting transversely opposite one another from a longitudinally extending tractor frame, a yoke coupled to the upright posts including a pair of legs extending forwardly from the post along opposite sides of the tractor and having forward ends joined together by a bight portion releasably secured to a transverse front end structure fixed to the forward end of the tractor frame, the improvement comprising: said front end structure having forward and top surfaces joined together and defining a desired configuration; said bight portion including opposite side members joined together by a horizontal cross member extending transversely beneath and being in contact with a bottom surface of said front end structure; a latch mechanism including a latch plate shaped complementary to said desired configuration; said latch plate extending between and being pivotally mounted to said side members for rotation about a horizontal axis, located just forwardly of said cross member, between a rearward closed position wherein it is in engagement with said forward and top surfaces and a forward open position wherein it is spaced away from said forward and top surfaces and a control rod connected to said latch plate for remotely moving said latch plate between said open and closed positions.

2. The loader defined in claim 1 wherein said forward and top surfaces of said front end structure are joined at substantially a right angle; and said latch plate having an inverted L-shaped cross section and including a first leg extending upwardly from said axis and a second end joined to and extending rearwardly from a top end of said first leg.

3. The loader defined in claim 2 wherein said front end structure is a weight bracket having a front, upright wall in the form of a rectangular plate, as viewed from the front; and at least one locating tab formed from a strap having a lower end fixed to a forward surface of said cross member; said locating tab having an upper rearwardly inclined portion for guiding the front upright wall of the weight bracket into a space between the cross member and the latch plate during mounting of the loader to the tractor.

4. The loader defined in claim 3 wherein said weight bracket includes a rear upright wall disposed in parallel relationship to said front wall; first and second pairs of stiffener ribs extending between and fixed to said front and rear walls with the pairs being located on opposite sides of and equidistant from a midpoint between opposite ends of the weight bracket; and a pair of centering tabs formed from straps having a vertical lower end portion welded to the top of and in crosswise relationship to said cross member; said centering tabs having oppositely outwardly inclined upper end portions with the pair of centering tabs being respectively located between the two stiffener ribs of each pair of ribs whereby during mounting of the loader to the tractor the centering tabs will act to center the bight portion relative to the weight bracket.

5. The loader defined in claim 1 wherein said side members are in the form of plates which are respectively fixed to the forward ends of the pair of yoke legs and extend downwardly therefrom; and a pair of support shoes respectively being fixed to a lower edge of each of said plates for engaging the ground and providing support for the loader when the latter is detached from the tractor.

6. The loader defined in claim 1 wherein said side members are in the form of plates which are respectively fixed to the forward ends of the pair of yoke legs; said latch mechanism including a rod extending between and rotatably mounted in said plates for rotation about said axis; a crank arm being fixed to and extending downwardly from said rod; and said control rod being connected to said crank arm.

7. The loader defined in claim 6 wherein said control rod is mounted for fore-and-aft movement above said crank arm; a link having a tubular upper end slidably received on said rod and a lower end pivotally coupled to said crank arm; first and second stops respectively fixed to the rod at locations behind and ahead of the tubular end; and a spring acting between the first stop and the tubular end and normally biasing the link forwardly so as to bias said latch plate toward its closed position.

8. The loader defined in claim 1 wherein said pair of legs of the yoke are tubular; and said control rod being located in one of said legs.

9. The loader defined in claim 1 and further including guide means fixed to and projecting upwardly from said cross member and including inclined surface means disposed for engaging said front end structure and effecting centering of said cross member beneath said front end structure as the cross member is raised toward said bottom surface of said front end structure during mounting of said yoke to said front end structure.

10. The loader defined in claim 9 wherein said inclined surface means of the guide means includes at least one pair of laterally spaced, upwardly and outwardly inclined surfaces and at least one pair of laterally spaced, upwardly and rearwardly inclined surfaces.

11. The loader defined in claim 1 wherein said side members are in the form of plates which are respectively fixed to the forward ends of the pair of yoke legs; and extend downwardly therefrom; and a ground support means being coupled to lower ends of said plates for engaging the ground and providing support for the loader when the latter is detached from the tractor.

12. The loader defined in claim 2 wherein said front end structure is a weight bracket having an upright front wall in the form of a rectangular plate, as viewed from the front, and right and left upright end walls joined to opposite ends of said front wall and including upper edges which include a downwardly stepped forward portion; and said second leg of said latch plate being notched at its outer rearward ends, when considered in its latched position, with rearward portions of said right and left upright walls being located in said notched outer rearward ends.

13. The loader defined in claim 12 wherein said second leg of said latch plate is provided with a pair of knock-out strips respectively spaced inwardly from opposite ends of said second leg so as to provide a spacing between said knock-out strips commensurate with the spacing between opposite end walls of an alternate weight bracket, whereby when such alternate weight bracket is used instead of said first named weight bracket the knock-out strips are removed and receive said opposite end walls of said alternate weight bracket.

* * * * *